US005897512A

United States Patent [19]

Zagame

[11] Patent Number: 5,897,512

[45] Date of Patent: Apr. 27, 1999

[54] MASSAGE APPLIANCE FOR MOVING OVER A PREDETERMINED ZONE OF THE HUMAN BODY

[76] Inventor: André Zagame, 55 rue de l'Eglise, 61110 Remalard, France

[21] Appl. No.: 08/835,520

[22] Filed: Apr. 8, 1997

[30] Foreign Application Priority Data

Apr. 9, 1996 [FR] France ..... 96 04402

[51] Int. Cl.[6] ..... A61H 7/00

[52] U.S. Cl. ..... 601/6; 604/313

[58] Field of Search ..... 601/6, 7, 10, 12; 606/201, 204, 204.15, 204.35; 604/313, 319

[56] References Cited

U.S. PATENT DOCUMENTS

| | | | |
|---|---|---|---|
| 1,983,601 | 12/1934 | Conn | 604/22 |
| 2,441,868 | 5/1948 | Casnati | 601/6 |
| 3,794,035 | 2/1974 | Brenner . | |
| 3,841,322 | 10/1974 | Spelio | 60/6 |
| 4,836,192 | 6/1989 | Abbate | 601/12 |

FOREIGN PATENT DOCUMENTS

| | | | |
|---|---|---|---|
| 1038311 | 9/1953 | France . | |
| 668052 | 11/1938 | Germany . | |
| 876301 | 5/1953 | Germany . | |
| 2243802 | 9/1973 | Germany . | |
| 213028 | 3/1924 | United Kingdom . | |
| 1077143 | 7/1967 | United Kingdom . | |
| 2126900 | 4/1984 | United Kingdom . | |
| 2261603 | 5/1993 | United Kingdom | 601/6 |

*Primary Examiner*—Danton D. DeMille
*Attorney, Agent, or Firm*—Sixbey, Friedman, Leedom & Ferguson; Gerald J. Ferguson, Jr.; Eric J. Robinson

[57] ABSTRACT

The invention relates to a massage appliance comprising a generally bell-shaped hollow body having a bottom opening defined by a peripheral edge. The hollow body has an internal partition extending substantially to the level of a plane containing said peripheral edge so as to define two mutually isolated compartments both connected to a pump member which serves to generate different desired degrees of suction in each of the compartments. A wave effect is thus obtained by means of the two areas of suction, thus reproducing the palpating-and-rolling action that has hitherto been performed manually in kinesitherapy.

11 Claims, 3 Drawing Sheets

MASSAGE APPLIANCE FOR MOVING OVER A PREDETERMINED ZONE OF THE HUMAN BODY

FIELD OF THE INVENTION

The invention relates to a massage appliance for moving over a predetermined zone of the human body, and more particularly a suction type massage appliance.

In the context of the invention, the term "massage" must be understood very broadly insofar as it seeks to treat various cutaneous or subcutaneous problems, in particular hypertrophic scars due to a surgical operation or localized winkles, or indeed zones of cellulite requiring reactivation of blood circulation.

BACKGROUND OF THE INVENTION

The effect of suction on blood circulation when the suction is exerted locally on the human body has been known for a long time, e.g. as applied with traditional suction cups placed at predetermined fixed locations.

Document GB-A-213 028 describes a suction massage appliance comprising a bell whose inside compartment is connected to a suction bulb. A diametrical roller is provided level with the thrust edge of the bell to produce a wave effect when the appliance is moved. Such a device exerts only a very limited massaging effect.

Document DE-A-668 052 describes a massage appliance based on a pressure-and-vacuum principle, with a two-compartment bell, one of which is subjected to positive pressure while the other is subjected to negative pressure. The effectiveness of such an appliance appears to be very doubtful insofar as positive pressure has very little effect on blood circulation in the zone concerned.

Subsequent attempts have been made to improve the massaging action to obtain a wave effect by relying on mechanical means in combination with suction.

Thus, document GB-A-1 077 143 describes a suction massage appliance implemented in the form of an applicator pad surrounded by a peripheral skirt defining a thrust rim, the inside face of the pad being shaped with undulations to generate a wave effect.

More recently, a massage appliance has been developed making use of motor-driven rollers combined with a suction system. In such an appliance, the skin of the zone concerned is pinched between two parallel-axis rollers so as to form a fold between the rollers, and the suction is applied to the top of the fold of skin formed in this way. The practitioner thus displaces the appliance over the zone concerned of the human body, the rollers being rotated by an electric motor, and suction is triggered together with movement of the appliance which moves under drive from the motor-driven rollers.

An appliance of that type suffers from a certain number of drawbacks, both for the practitioner and for the patient being subjected to the massaging operation. The practitioner finds it difficult to observe the single fold formed between the rollers pinching the skin, and the therapeutic action of suction is restricted to the top of the fold formed in the skin, such that said action is de facto limited. Also, for the patient, the massage operation is uncomfortable because of the sensation of pinching exerted by the rollers, thus requiring the practitioner to be highly skilled in handling the appliance. Also, that known appliance is difficult to adjust in order to adapt it to various types of skin problem to be treated. Finally, it should also be observed that the appliance is of relatively expensive design insofar as it is made up of a large number of component parts (more than two hundred).

OBJECTS AND SUMMARY OF THE INVENTION

An object of the invention is to provide a massage appliance that is more effective than the above-mentioned appliance, simultaneously with respect to its structure, its ease of use for the practitioner, and the quality and the comfort of the action it exerts.

The invention thus seeks to provide a massage appliance that is designed to be placed on a predetermined zone of the human body, enabling action to be exerted that is as close as possible to the action that would be performed manually by a practitioner, for example the palpating-and-rolling action well known in kinesitherapy and until now performed only manually by practitioners, and optionally enabling said action to be exerted on zones of the human body that are difficult to reach.

More particularly, the invention provides a massage appliance for placing on a predetermined zone of the human body, comprising a generally bell-shaped hollow body having a bottom opening defined by a peripheral edge via which said appliance is applied to the zone to be massaged, said hollow body having at least one internal partition extending substantially to the same level as the plane containing the said peripheral edge so as to define mutually isolated compartments which are connected to a pump member serving to generate different desired degrees of suction in each of the compartments.

There may be one or more internal partitions, in particular there may be two internal partitions giving three compartments with different degrees of suction and a triple wave effect.

In practice, a single partition is used for reasons of manufacturing cost. Under such circumstances, because of the presence of two mutually isolated compartments, it is possible to apply dual suction to the zone of the human body on which the massage appliance is applied, said dual suction making it possible to obtain a wave effect having two crests in the skin of the patient, thereby reproducing the palpating-and-rolling effect previously performed manually by practitioners. When the practitioner moves the massage appliance over the predetermined zone of the human body, the two crests move together like a wave front, and in addition suction is applied to the entire zone surrounded by the bottom opening of the bell-shaped hollow body.

Preferably, the internal partition is disposed in such a manner that the two compartments it defines are of significantly different volumes.

In particular, it is advantageous to provide for the upstream compartment, relative to the displacement direction, to be of a volume that is considerably smaller than the downstream compartment. For example, the downstream compartment may have a volume that is about twice that of the upstream compartment.

This characteristic is particularly advantageous for generating an asymmetrical dual wave with an upstream crest that is relatively lower and a downstream crest that is relatively higher. This lifts the skin in a manner that is highly favorable for the massaging action being exerted.

As a particular example, the peripheral edge may be terminated in a thrust rim and it may be substantially circular or elliptical in shape, and the internal partition may be substantially plane, having a substantially rectilinear free edge likewise terminated in a thrust rim. The two thrust rims impart a feeling of comfort that is very satisfactory for the patient. Naturally, in a variant, other shapes of bottom opening could be provided for the bell-shaped hollow body, in particular shapes that are more elongate in appearance, or indeed that are curved.

The two compartments may be connected to the pump member by means of a common pipe, or in a variant they may be connected to said pump member via associated respective pipes. This makes it possible to control accurately the suction exerted in each of the isolated compartments. It may also be advantageous to provide for the suction generated in the two compartments by the pump member to be adjustable, thereby making it possible in highly satisfactory manner to adapt the dual suction action to the type of cutaneous or subcutaneous problem concerned.

Also, advantageously, the hollow body and its internal partition should be made of a translucent material, e.g. glass or an appropriate plastics material. This enables the practitioner to monitor at all times the zone subjected to the dual suction, and in particular to move the appliance accurately and at the required speed over a critical zone, for example over a hypertrophic scar or a winkle of shape and location that are particularly difficult.

For small zones, or indeed zones that are difficult to reach and/or work on (e.g. between the fingers or an ala of the nose), it is necessary to use a very small bell (e.g. having a volume of less than 100 $cm^3$). Making a small bell with a partition then becomes difficult and expensive.

The invention also provides a massage appliance specially designed to overcome such difficulties while conserving the same principle of generating different degrees of suction.

The invention thus provides a massage appliance for placing on a predetermined zone of the human body, the appliance comprising two generally bell-shaped hollow bodies having respective bottom openings defined by respective peripheral edges whereby the appliance is applied to the zone to be massaged, said hollow bodies defining two compartments which are connected to a pump member in such a manner as to generate different desired degrees of suction in each of the two compartments.

The use of two separate hollow bodies makes a small-sized embodiment possible, and also gives the practitioner great flexibility in use, in particular enabling a special stretching massaging action to be performed by moving the two hollow bodies apart from each other.

Advantageously, each hollow body has a plane side facet enabling the two hollow bodies to be brought next to each other by brining said two plane facets together. When the two hollow bodies are next to each other, they perform exactly the same action as the above-specified single bell having two degrees of suction.

Provision may be made for the two compartments to be individually connected to the pump member via independent associated pipes. The two compartments may then both have the same volume or they may have different volumes.

In a variant, provision may be made for the two compartments to be connected to the pump member by associated respective pipes connected via a common T-piece itself directly connected to said pump member, and the two compartments may then have significantly different volumes. This solution is cheaper since the required pump member is then simpler.

Preferably, the suction generated by the pump member in each of the two compartments is adjustable.

Finally, it is advantageous for the two hollow embodies to be made of a translucent material, for example glass or an appropriate plastics material.

BRIEF DESCRIPTION OF THE DRAWINGS

Other characteristics and advantages of the present invention appear more clearly in the light of the following description and the accompanying drawings, relating to a particular embodiment, and with reference to the figures in the accompanying drawings, in which.

MORE DETAILED DESCRIPTION

Figure 1:
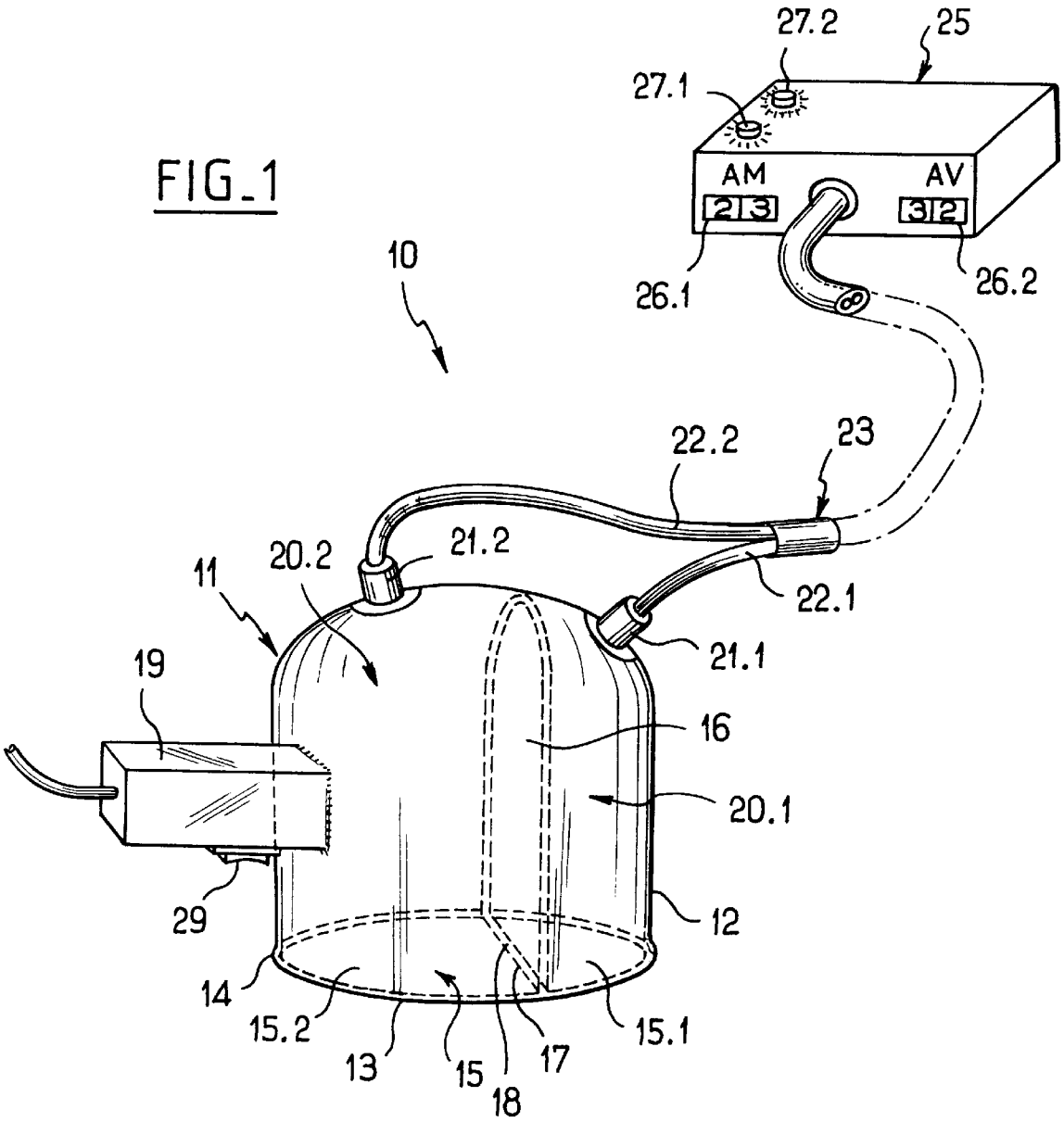
FIG. 1 is a perspective view of a massage appliance of the invention, of the type comprising a bell having a single internal partition.
Figure 4:
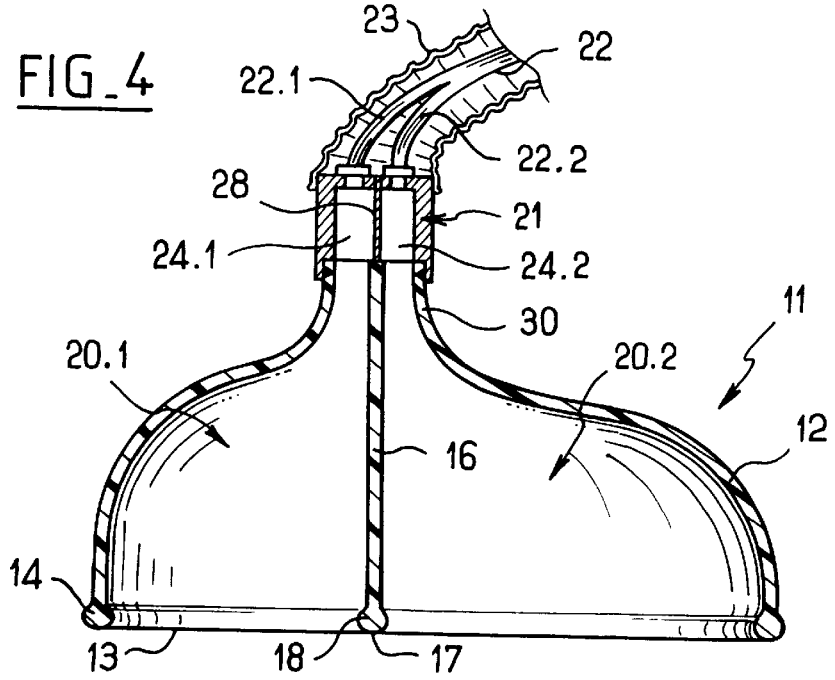
FIG. 4 is a fragmentary view in axial section showing a variant of the above appliance in which a single endpiece is used for connecting the hollow bell-shaped body to the pump member.

FIG. 1 shows a massage appliance 10 of the invention which is designed to be moved over a predetermined zone of the human body. The appliance comprises a generally bell-shaped hollow body 11 having a bottom opening 15 defined by a peripheral edge 13 whereby said appliance is placed against the zone to be massaged. The main portion of the hollow body, referenced 12, is generally cylindrical in shape, but could have some other shape, for example it could have a narrower top portion, as shown in the variant of FIG. 4.

The hollow body 11 has at least one internal partition, in the present case a single partition 16 extending substantially as far as the plane containing the peripheral edge 13 so as to define two compartments 20.1 and 20.2 which are isolated from each other, said two compartments being connected to a pump member 25 that serves to generate the different desired degrees of suction in the two compartments. If two internal partitions are used (in a variant not shown), then there will be three compartments with different degrees of suction, thus enabling a triple wave effect to be achieved.

Figure 2:
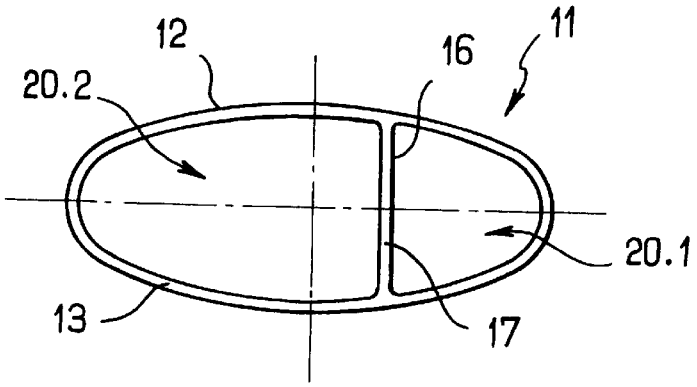
FIG. 2 is a view of the bell-shaped hollow body as seen from beneath, showing more clearly the particular organization of the two openings and the sections selected for them in order to give, in this case, suction in the downstream compartment that is as about twice as strong as the suction in the upstream compartment.

The peripheral edge 13 is preferably terminated by a thrust rim 14, and the internal partition 16 which is preferably plane in this case, has a free edge referenced 17 that is substantially rectilinear and that advantageously terminates likewise in a thrust rim 18. Thus, in the plane where the hollow bell-shaped body opens out, there is a thrust rim whose shape is preferably rounded, both at the periphery of the hollow body and along the free edge of the internal partition, as can be seen in FIG. 2. This pair of openings defines the outline of the zone of the human body to which dual suction is applied and serves specifically to generate a wave effect with two successive crests when the appliance is applied by the practitioner to the zone concerned of the human body and the pump member is simultaneously operated to generate the desired pressure.

Figure 3:
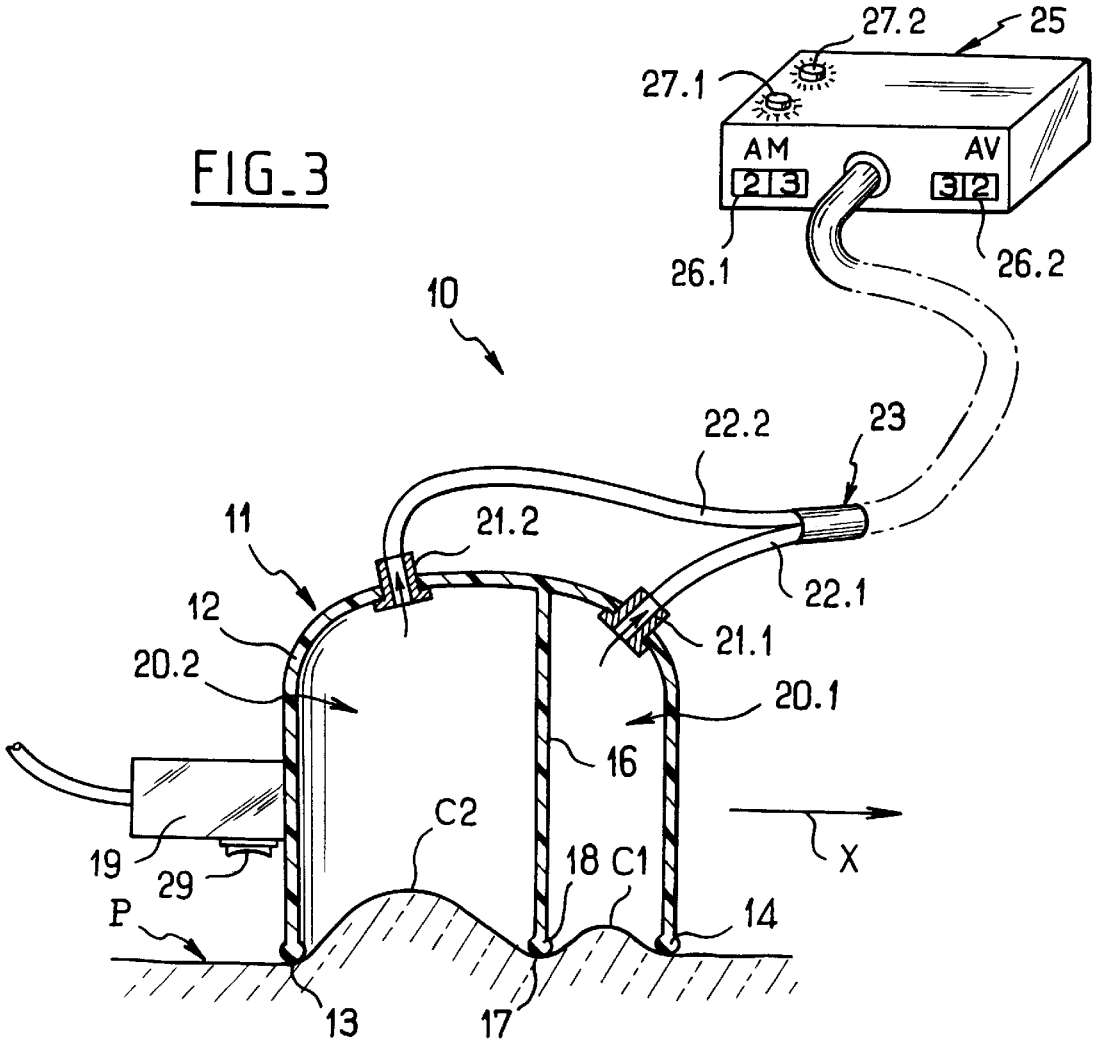
FIG. 3 is partially in section and shows the above-massage appliance in use, and also shows the particular wave effect comprising two crests within the corresponding zone of the human body.

The action exerted by the massage device of the invention will be better understood on referring to FIG. 3. X shows the direction in which the massage appliance 10 is moved while it is applied against a zone P of the human body. When the pump member 25 is in operation, the suction generated in each of the compartments 20.1 and 20.2 exerts localized suction in each of the zones defined by the two outlets, thereby creating a wave effect that is extremely favorable, having a first crest C1 in the upstream or leading compartment 20.1 and a second crest C2 in the downstream or trailing compartment 20.2. This dual crest faithfully reproduces the palpating-and-rolling action that has until now been exerted by practitioners only in purely manual manner.

The generally bell-shaped hollow body 11 can be connected to the pump member 25 in numerous different ways. Thus, in FIGS. 1 and 3, there are shown two endpieces 21.1 and 21.2 forming feedthroughs that pass through the top portion of the hollow body 11, each in association with a respective one of the compartments 20.1 and 20.2 which are separated by the internal partition. Corresponding pipes or ducts 22.1 and 22.2 are fitted to each of the endpieces 21.2 and 21.2, and the assembly is generally housed in an optionally ringed covering 23 surrounding the two ducts as far as their connection with the pump member 25. There is also shown a handle 19 enabling the practitioner to grasp the massage appliance 10 firmly so as to be able to move it accurately over the zone concerned of the human body. The handle 19 may also be provided with a trigger switch 29 enabling the practitioner to switch the pump member 25 on or off remotely.

The two compartments 20.1 and 20.1 may be connected by a common pipe to the pump member, or they may be connected individually to said pump member via associated respective pipes. The first case is easy to implement, but imposes a given degree of suction generated by the pump member. The second case is more complex to implement, but it provides finer adjustment of the suction exerted on each of the individual compartments without any need to change appliance. The second case is shown in FIGS. 1 and 3, where the pump member 25 is shown diagrammatically as including display means 26.1 and 26.2 providing a direct readout of the suction exerted in the upstream compartment 20.1 (marked AM) and the downstream compartment 20.2 (referenced AV). In this case, the pump member 25 also has adjustment knobs 27.1 and 27.2 enabling suction which is obtained in each of the compartments to be set to a respective predetermined value. Thus, the suction generated in the two compartments 20.1 and 20.2 by the pump member 25 can either be constant or it can be adjustable.

It is also desirable to be able to select an appropriate size for each of the two compartments and their respective openings so as to obtain a satisfactory palpating-and-rolling effect in the immense majority of cases to be treated. It is then advantageous to provide for the internal partition 16 to be disposed in such a manner that the two compartments 20.1 and 20.2 that it defines are of significantly different volumes, and in this case it is preferable for the upstream compartment 20.1 to be considerably smaller than the downstream compartment 20.2. By way of example, the volume of the downstream compartment 20.2 may be about twice the volume of the upstream compartment 20.1.

Merely by way of indication, there follow suitable dimensions for the hollow bell-shaped body and for its internal partition. The peripheral edge may be elliptical in shape, having its major axis perpendicular to the partition, said edge lying in a rectangle that is 5 cm wide and 8 cm long, with the length of the upstream compartment (along the major axis) being 3 cm and the length of the downstream compartment being 5 cm. With a height of about 7 cm, section lying in the range 150 millibars or hectopascals (hPa) to 600 hPa, is generally satisfactory for obtaining the looked-for therapeutic action, with suction of up to 250 hPa in the upstream compartment and in the range 250 hPa to 500 hPa in the downstream compartment. This produces the desired dual wave as shown diagrammatically in FIG. 3. It is possible to provide a plurality of preprogrammed ranges, e.g. three ranges: 150 hPa to 350 hPa; 300 hPa to 500 hPa; and 400 hPa to 600 hPa, with the practitioner selecting the ranges most suitable for the problem to be treated. The pump member 25 may also be fitted with a sequencer (or timer) means, e.g. enabling it to generate suction of 450 hPa for 10 seconds, followed by suction of 200 hPa for 2 seconds (said means preferably being programmable and enabling the practitioner to observe the maximum and minimum peak values of the suction and of the corresponding durations).

The hollow body and its internal partition are preferably made of translucent material, e.g. glass or an appropriate plastics material, thereby enabling the practitioner at all times to monitor the appearance of the zone being massaged, while also making it easier to position the two openings relative to critical zones, such as winkles or hypertrophic scars. The thickness of the hollow body and of its partition may be a few millimeters, and the thrust rims are preferably chosen to have a diameter of about 5 mm. FIG. 4 shows a variant in which the hollow body 11 has a main portion 12 that is in the form of an upside-down funnel shape, with the top portion tapering to form a neck 30 on which a single endpiece 21 is fitted for connection to the pump member 25. In this variant, the partition 16 is located on the axis of the neck 30, and it extends upwards into the lip around said neck. A single endpiece 21 can then be provided, optionally having an internal divider 28 (to enable different pressures to be applied to the two compartments), co-operating with two distinct passages 24.1 and 24.2 each individually connected to a separate branch 22.1 and 22.2 if it is desired to feed each of the compartments separately so that the appliance can be connected to the pump member 25 in a single operation. If the suction generated is the same (single pipe 22, optionally splitting into two branches 22.1 and 22.2 as shown herein), then the divider 28 could naturally be omitted.

A massage appliance is thus provided which is both very simple structurally speaking and very effective concerning its therapeutic action. In addition, it makes it possible for the first time to reproduce the palpating-and-rolling action performed manually by practitioners, and it does this with optimum comfort for the patient.

A variant embodiment is described below with reference to FIGS. 5 and 6 in which two separate hollow bell-shaped bodies are used, without an internal partition, and with different amounts of suction being generated in each of the two compartments as defined by said hollow bodies.

For reasons of convenience, the same reference numerals are used as in the above embodiments that have a single bell.

Figure 5:
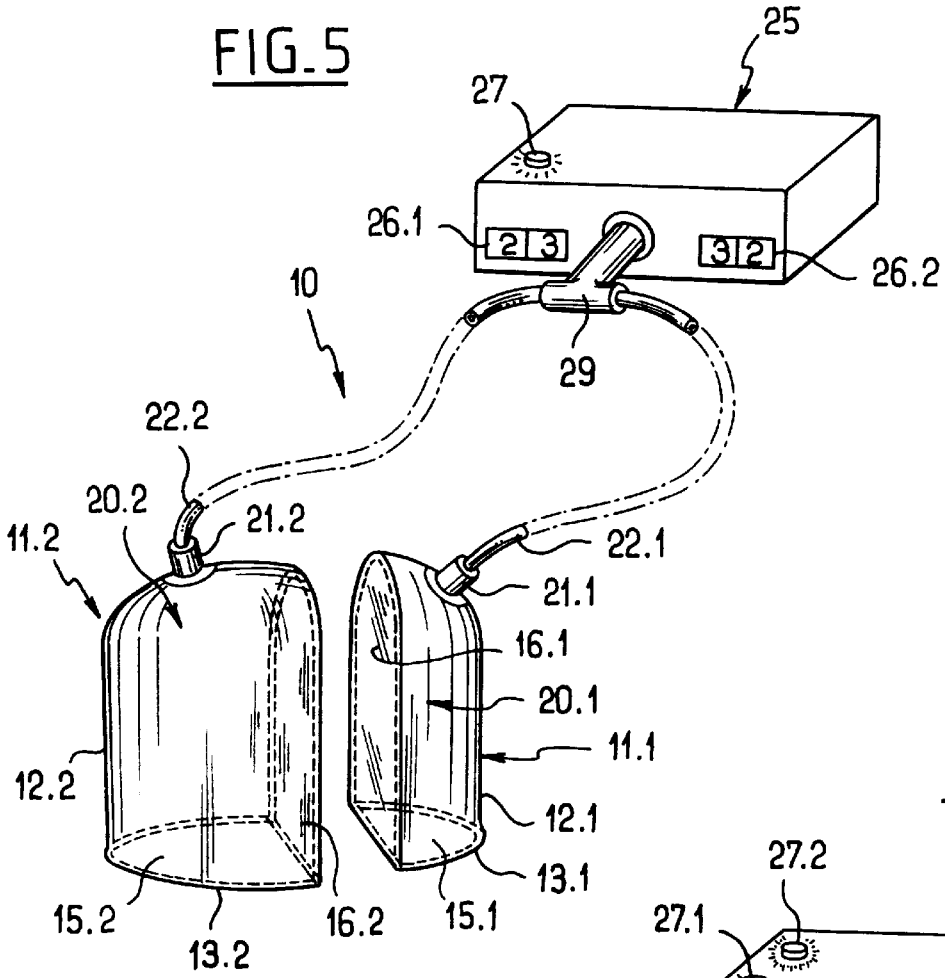
FIGS. 5, and 6 show a variant embodiment in which two hollow bodies are used that can be moved relative to each other, the associated compartments giving different degrees of suction via a common connection to the pump member (FIG. 5) or via respective individual connections (FIG. 6).

In FIG. 5, there can thus be seen two hollow bell-shaped bodies 11.1 and 11.2, having respective main portions 12.1 and 12.2 and peripheral thrust edges 13.1 and 13.2 defining bottom openings 15.1 and 15.2. The hollow bodies 11.1 and 11.2 define respective compartments 20.1 and 20.2. The compartments 20.1 and 20.2 are connected via endpieces 21.1 and 21.2 and pipes or ducts 22.1 and 22.2 to a pump member 25 which serves to generate different amounts of suction in each of the two compartments.

In this case, the pipes 22.1 and 22.2 are connected to a common T-piece 29 that is itself directly connected to the pump member 25. This simplifies the pump member 25 since it is designed to deliver a single amount of suction (adjustable by the knob 27). By choosing significantly different volumes for the two hollow bodies 11.1 and 11.2, different degrees of suction are obtained directly in the two compartments 20.1 and 20.2, and the a greater the difference in volume the greater the difference in pressure. Prior calibration makes it possible to display at 26.1 and 26.2 the degrees of suction in each of the two bells so as to enable the massage process to be followed more closely.

The use of two separate bells makes it possible to miniaturize the appliance, thus enabling small zones of the human body to be massaged which would otherwise be difficult to reach and/or to work on (e.g. the gap between the fingers, or the toes, or the sides of the nose), and this can be done without increasing manufacturing cost and while avoiding the sealing problems that would be encountered with a single bell of very small dimensions. In addition, the practitioner can also act by moving the two bells away from each other or towards each other so as to obtain a particular effect: specifically, moving them apart makes it possible to achieve an action that is very close to the palpating-and-rolling action.

In this case, the two bells 11.1 and 11.2 have respective plane side facets 16.1 and 16.2. This means that they can be moved towards each other and even brought into contact by bringing their plane facets 16.1 and 16.2 into contact (thus providing an appliance equivalent to the above-described single-bell embodiment). It would also be possible to provide a conventional bell-shape having no plane side facets.

Figure 6:
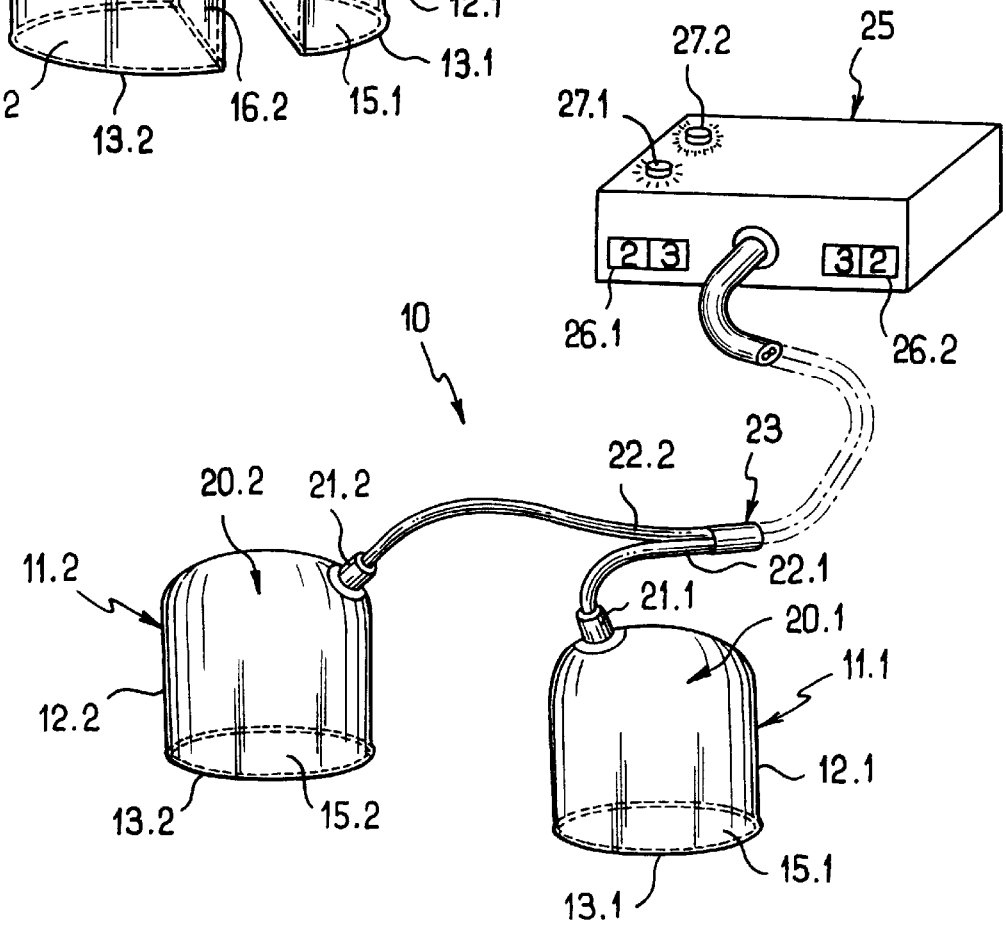

FIG. 6 differs from FIG. 5 in that the two bells are of a normal bell-shape (no plane lateral facets), and in that the connection to the pump member 25 is the same as that shown in FIG. 1: each of the two compartments 20.1 and 20.2 (which may now be of the same volume) is connected individually to the pump member 25 via an associated respective pipe 21.1 or 21.2. A pump member 25 (now more complex than the member of FIG. 5) needs to be capable of generating two different amounts of suction, so as to obtain different amounts of suction in the two compartments 20.1 and 20.2.

In all cases, the suction generated in the two compartments 20.1 and 20.2 is preferably adjustable (knob 27 in FIG. 5, knobs 27.1 and 27.2 in FIG. 6).

Finally, the two hollow bodies 11.1 and 11.2 are preferably made of translucent material as for the single-bell appliance, e.g. glass or an appropriate plastics material.

The invention is not limited to the embodiments described above, and on the contrary it covers any variant that uses equivalent means to reproduce the essential characteristics specified above.

I claim:

1. A massage appliance for placing on a predetermined zone of the human body, the appliance comprising a generally bell-shaped hollow body having a bottom opening defined by a peripheral edge via which said appliance is applied to the zone to be massaged, said hollow body having at least one internal partition extending substantially to the same level as the plane containing the said peripheral edge so as to define mutually isolated compartments which are connected to a pump member, said at least one partition being disposed in such a manner that the compartments are of significantly different volumes in order to have different degrees of suction in each of said compartments.

2. An appliance according to claim 1, wherein there is a single internal partition disposed in such a manner as to define two compartments of significantly different volumes.

3. An appliance according to claim 2, wherein one of the two compartments is referred to as an upstream compartment when considering a displacement direction of said appliance on said predetermined zone of the human body, the other compartment then being referred to as a downstream compartment said upstream compartment further having a volume that is considerably smaller than said downstream compartment.

4. An appliance according to claim 3, wherein the downstream compartment is about twice the volume of the upstream compartment.

5. An appliance according to claim 2, wherein the peripheral edge is terminated by a thrust rim and is substantially circular or elliptical in shape.

6. An appliance according to claim 2, wherein the internal partition is essentially planar, having a free edge that is substantially rectilinear and that is terminated by a thrust rim.

7. An appliance according to claim 2, wherein the two compartments are connected to the pump member via a common pipe.

8. An appliance according to claim 7, wherein the pump member is designed to deliver in said common pipe a single amount of suction that is adjustable by a corresponding knob.

9. An appliance according to claim 2, wherein the two compartments are individually connected to the pump member via associated respective pipes.

10. An appliance according to claim 9, wherein the pump member is designed to deliver in said pipes two respective amounts of suction that are individually adjustable by corresponding knobs.

11. An appliance according to claim 2, wherein the hollow body and its internal partition is made of translucent material, e.g. glass or an appropriate plastics material.

* * * * *